US010420398B2

(12) United States Patent
Drage

(10) Patent No.: US 10,420,398 B2
(45) **Date of Patent: *Sep. 24, 2019**

(54) RELEASABLE INTERLOCKING FASTENING DEVICES

(71) Applicant: Michael Robert Drage, Shrewsbury (GB)

(72) Inventor: Michael Robert Drage, Shrewsbury (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/029,890

(22) Filed: Jul. 9, 2018

(65) Prior Publication Data

US 2019/0008238 A1 Jan. 10, 2019

Related U.S. Application Data

(66) Continuation of application No. 14/898,453, Substitute for application No. PCT/GB2014/000235, filed on Jun. 13, 2014, now Pat. No. 10,016,021.

(30) Foreign Application Priority Data

Jun. 13, 2013 (GB) ..... 1310580.4

(51) Int. Cl.
*A44B 17/00* (2006.01)
*A44C 3/00* (2006.01)

(52) U.S. Cl.
CPC ..... *A44B 17/0041* (2013.01); *A44B 17/0023* (2013.01); *A44B 17/0076* (2013.01); *A44C 3/001* (2013.01); *A44B 17/007* (2013.01)

(58) Field of Classification Search
CPC ... A44B 1/34; A44B 17/0023; A44B 17/0076; A44B 17/0029; A44B 17/0035; A44B 17/0041; A44B 17/0064; A44B 17/007; A44C 3/001; Y10T 24/366; Y10T 24/23; Y10T 24/45775; Y10T 24/44034; Y10T 24/3683; Y10T 24/3685; Y10T 24/3698; E05B 73/0017; G09F 7/02
USPC ..... 40/360, 636, 662, 663, 668
See application file for complete search history.

(56) References Cited

U.S. PATENT DOCUMENTS

| | | | |
|---|---|---|---|
| 1,096,897 | A | 5/1914 | Fisher |
| 1,604,913 | A | 12/1924 | Hattingberg |
| 1,733,650 | A | 10/1929 | Cummings |
| 1,775,042 | A | 9/1930 | Lemoine |
| 1,891,637 | A | 12/1932 | Frank |
| 2,118,561 | A | 4/1936 | Kleeberg |
| 2,041,506 | A | 5/1936 | Woolson |
| 2,041,606 | A | 5/1936 | Hofmann |
| 2,246,852 | A | 6/1941 | Kale |
| 2,497,305 | A | 2/1950 | Isaac et al. |
| 2,647,261 | A | 8/1953 | Rassner |

(Continued)

FOREIGN PATENT DOCUMENTS

| | | |
|---|---|---|
| EP | 1634508 | 3/2006 |
| FR | 864346 | 4/1941 |

(Continued)

*Primary Examiner* — Jack W Lavinder

(57) ABSTRACT

A releasable interlocking device comprising a pair of interactive plates, for fastening to apparel utilizing a system of two interactive plates which when brought together utilizes the thickness of the apparel and stud of a male plate to engage through the lips of the female plate to snap fit and lock without damage to the aforesaid apparel.

18 Claims, 5 Drawing Sheets

(56) References Cited

U.S. PATENT DOCUMENTS

| | | | | |
|---|---|---|---|---|
| 2,685,690 | A | 8/1954 | Chrisman | |
| 2,863,197 | A | 12/1958 | Statham | |
| 2,895,199 | A * | 7/1959 | Jones | A44B 17/0029 24/618 |
| 2,969,574 | A | 1/1961 | Blake | |
| 2,981,992 | A | 5/1961 | Jawoll | |
| 3,010,169 | A | 11/1961 | Carpinella | |
| 3,094,757 | A | 6/1963 | Blake | |
| 3,416,200 | A | 12/1968 | Daddona, Jr. | |
| 3,720,982 | A | 3/1973 | Myers et al. | |
| 4,007,515 | A | 2/1977 | Agnelli | |
| 4,242,886 | A | 1/1981 | Tucker | |
| 4,392,279 | A | 7/1983 | Schwager | |
| 4,875,237 | A | 10/1989 | Cohen | |
| 4,959,890 | A | 10/1990 | Pazurek | |
| 4,970,766 | A | 11/1990 | Hsiau et al. | |
| 5,113,553 | A | 5/1992 | Hutchinson | |
| 5,115,548 | A | 5/1992 | Nysten | |
| 5,299,324 | A | 4/1994 | Zinna | |
| 5,581,815 | A | 12/1996 | Hans | |
| 5,940,942 | A * | 8/1999 | Fong | A44B 1/34 24/108 |
| 6,266,853 | B1 | 7/2001 | Ho | |
| 6,408,444 | B1 | 6/2002 | Zinna | |
| 6,527,615 | B1 | 3/2003 | Boehler | |
| 6,568,044 | B1 | 5/2003 | Kidd | |
| 7,788,772 | B2 | 9/2010 | Dandurand | |
| 8,595,867 | B1 | 12/2013 | Zinna | |
| 9,320,326 | B2 | 4/2016 | Greenspoon | |
| 9,986,794 | B2 | 6/2018 | Greenspoon | |
| 2006/0230583 | A1 | 10/2006 | Chen | |
| 2008/0147116 | A1 | 6/2008 | Smith et al. | |
| 2011/0041295 | A1 | 2/2011 | Reiter | |

FOREIGN PATENT DOCUMENTS

| | | | |
|---|---|---|---|
| FR | 1350098 | 1/1964 | |
| GB | 850884 | 10/1960 | |
| GB | 951000 | 3/1964 | |
| JP | 007042327 | 10/1995 | |
| JP | 2005189647 | 7/2005 | |
| NL | 6611411 | 8/1966 | |
| WO | WO-2009007476 A1 * | 1/2009 | A44B 17/0035 |

* cited by examiner

RELEASABLE INTERLOCKING FASTENING DEVICES

CROSS-REFERENCE TO RELATED APPLICATIONS

This application is a continuation of prior application Ser. No. 14/898,453, filed Dec. 14, 2015, which was the National Stage of International Application No. PCT/GB2014/000235, filed Jun. 13, 2014, which claims foreign priority to GB1310580.4, filed Jun. 13, 2013.

TECHNICAL FIELD

The present invention relates generally to fasteners and more particularly to fasteners comprising two plates which fasten an event identification number to apparel without piercing the apparel.

BACKGROUND ART

Such apparel and event identification numbers may comprise many varied materials including Lycra®, cotton, nylon and, in the case of displaying numbers, a lightweight paper-based material. It is well-known that in this circumstance the traditional, typical fastening method is via a standard pin, or standard safety pin attached to the four corners of a number and pushed through to pierce the participant's apparel twice to secure in place.

With the development of more sophisticated and expensive sports apparel to meet the needs of the modern recreational and elite athlete, coupled with a rising popularity of mass participation sporting events, often highly competitive, the design of the connecting interface between the participant's mandatory identification event number and the participant's apparel has not advanced; safety pins are still the usual method of attaching numbers.

It is well known that there exists a belt for multi-sport which can have an identification number affixed to it such that when the number is facing rearwards it is suitable for the bike leg of the event and when the belt is swivelled 180 degrees around the waist to the front of an athlete's body it can then be suitable for the run leg of a duathlon or a triathlon for example. However, such belts are expensive and only facilitate the connection of a number along the top edge, not including the bottom edge, rendering inconsistent visibility and recognition of the aforesaid number during an event, especially in windy conditions with the tendency to flap about.

These commonplace connection systems have drawbacks as outlined above. Furthermore, by resorting to safety pins the athlete needs to pierce an expensive skin suit, expensive all in one tri-suit, or charity running vest, or expensive outfit in a dance or game show scenario, for example, and contend with the possible damage to the apparel as a result of holes made with the pin and repetitive holes made over time and the tearing which may take place during detachment. Indeed safety pins constitute a danger for the safety of the athlete, in case of their accidental opening, following, for example, an athlete's fall off the bike or a trip on the run.

The object of the present invention is to provide a fastener for securing an event identification number on an athlete's apparel which overcomes the drawbacks of known devices.

A further object of the present invention is to provide a fastener for securing a competition, or participation, event identification number on the apparel worn by an athlete without the need for stitching or other operations which may damage the material of the apparel. The present invention can be contrasted with a known device as described in EP1634508, which purports to solve the problems described above.

SUMMARY OF THE INVENTION

The present invention provides a releasable interlocking device specifically adapted to fasten an event identification number to apparel. The device includes a female plate with a planar first surface and an arcuate or domed second surface, the female plate including a central recess in the second surface and a central orifice defined by a lip at the first surface. The device further includes a male plate with an integral stud head that protrudes from a planar surface and includes an overlapping stud head. The stud head is sized and configured to pass through a hole in the event identification number positioned adjacent the apparel and to push a portion of the apparel covering the stud head through the central orifice in the female plate, thereby disposing the stud head and the portion of apparel in the central recess of the female plate and disposing another portion of the apparel between the first surface of the female plate and the planar surface of the male plate, to fasten the event identification number to the apparel.

The central orifice at the second surface may be circular or non-circular. The central recess may have an opening at the second surface, and the central orifice may be offset relative to the opening at the second surface. The female plate may include a peripheral edge and have a curved first part and a straight second part that extends along a chord of the curved first part. In one non-limiting embodiment, the central orifice of the female plate is a non-circular central orifice defined by a shaped lip, which flexes when the stud of the male plate and apparel are presented for fastening in the central recess. In another non-limiting embodiment, the central orifice of the female plate is defined by a shaped lip, which flexes when the stud of the male plate and apparel are presented for fastening in the central recess.

DRAWINGS

Figure 1:
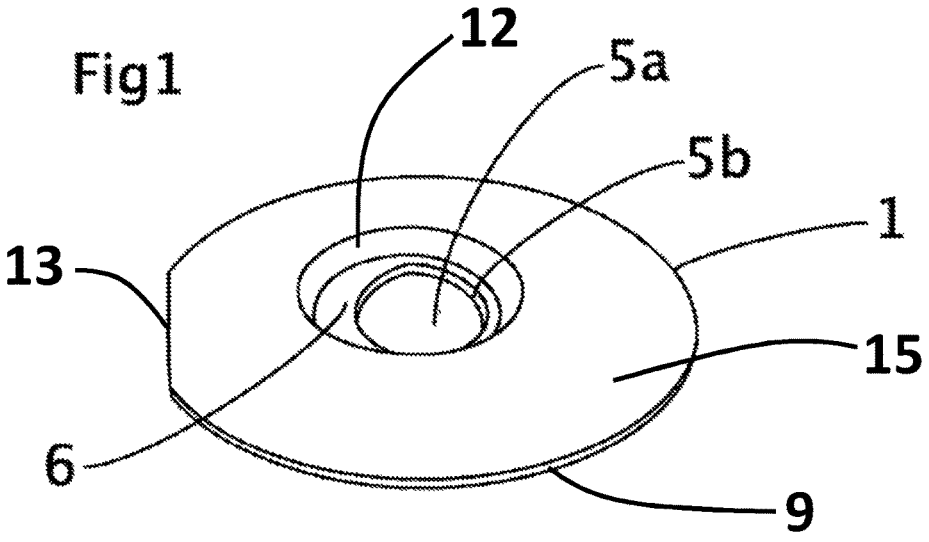
FIG. 1 is an isometric projection view of a female plate of a releasable interlocking device according to the present invention.
Figure 2:
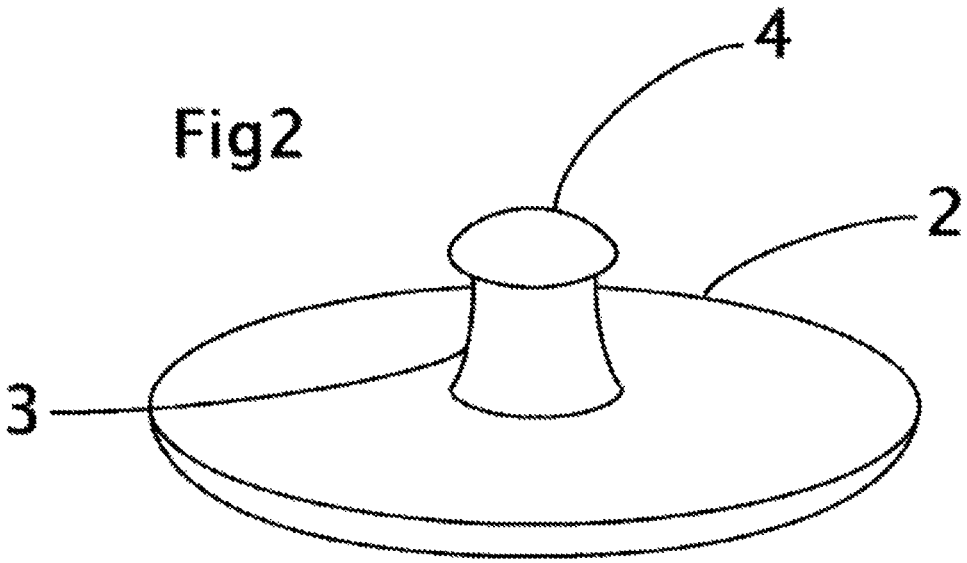
FIG. 2 is an isometric projection view of a male plate of a releasable interlocking device according to the present invention.
Figure 4A:
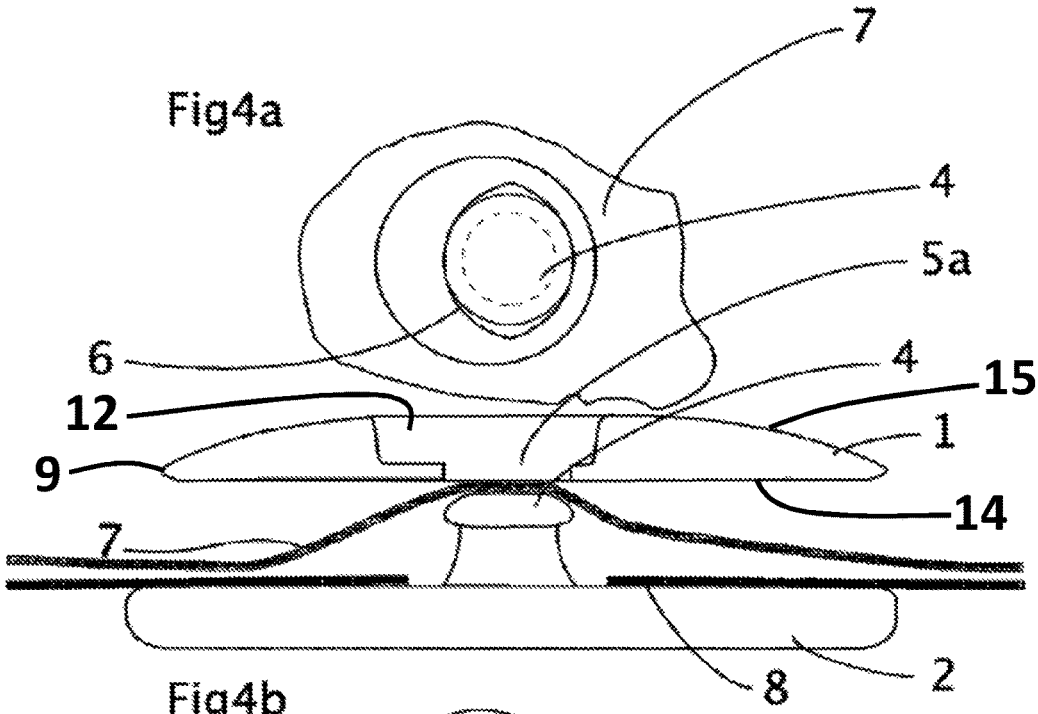
Figure 4B:
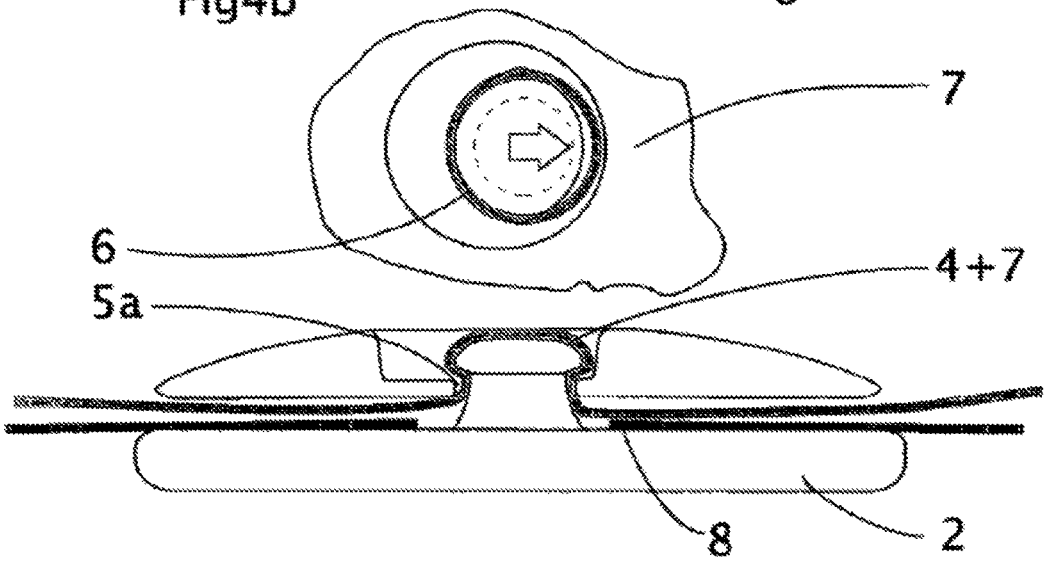
Figure 5:
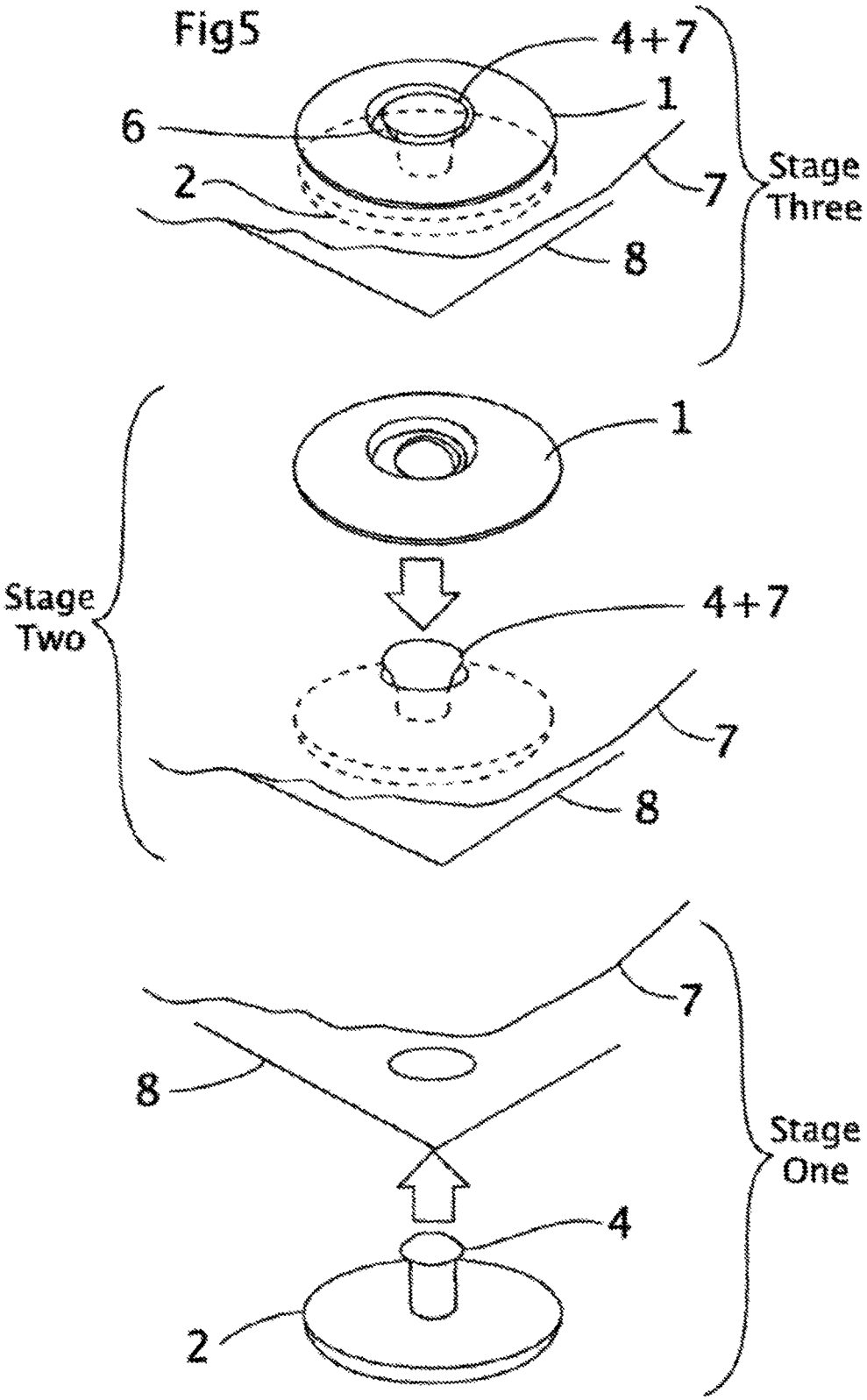

FIG. 4*a* is a third angle projection showing a top plan and cross sectional view of the female and male plates shown in FIGS. 1 and 2, respectively, with the stud head of the male plate enveloped by fabric from a competitor's or participant's apparel, extending through a hole in the event identification number and before being snap-fitted into the offset elliptically shaped orifice of the female plate;

FIG. 4*b* is a third angle projection showing a top plan and cross sectional view of the female and male plates shown in FIGS. 1 and 2, respectively, with the stud head of the male plate snap-fitted into the offset elliptically shaped orifice of the female plate; and FIG. 5 is detailed exploded isometric projection views showing the assembly sequences of the releasable interlocking fastening device according to the present invention.

SPECIFIC DESCRIPTION

FIG. 1 shows a female plate 1 comprising an offset elliptically shaped orifice 5*a* with narrow ledge 5*b* (or non-flexible lip) traversing the inside perimeter of the central recess 12 in the female plate until it meets a flexible lip 6 which is characterised by having a more substantial ledge. Featured on the outside surface of the female plate 1 can be a form of identification, which is typically molded into the surface, or printed on the surface, or molded in relief. It will be appreciated that such a female plate shown in FIG. 1 may be of any shape. According to one aspect of the present invention, the female plate 1 has a peripheral edge 9 that preferably includes a circular first part and a straight second part that extends along a chord 13 of the circular first part.

FIG. 2 shows a male plate 2. Molded at right angles to the inside surface of the male plate 2, and typically positioned in its centre, is a tapered stud 3, the end of which features an overlapping hemi-spherical head 4, which may be partly domed. The male plate 2 may be of any shape.

Figure 3:
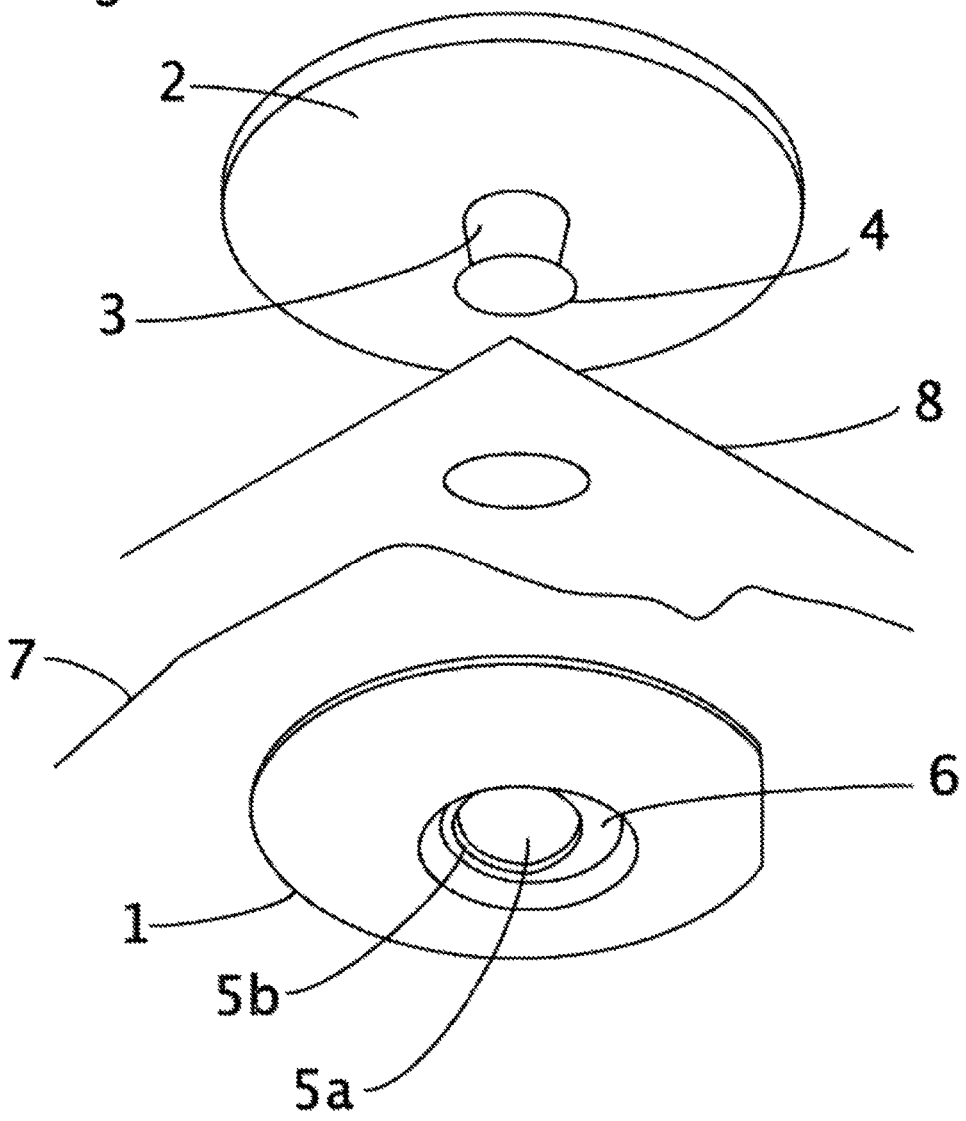
FIG. 3 is an exploded isometric projection view of the female and male plates shown in FIGS. 1 and 2, respectively, together with an event identification number and a competitor's or participant's apparel.

FIG. 3 shows an exploded assembly where the female plate 1 is shown positioned inside clothing apparel 7. In order to push and lock male plate 2 into the female plate 1, and thus secure the event identification number 8, the stud 3 is pushed through a typical hole in the event identification number 8 before being offered up against the apparel 7. As a result, the stud 3 with apparel sleeved over it becomes exposed ready for the female plate 1 to snap-fit over the stud head 4 to secure the event identification number 8 by locking into the elliptically shaped orifice 5*a* by means of the flexible lip or vane 6 molded around the inside surface of the orifice.

FIG. 4*a* shows the orthographic projection of stud head 4 pushed through the hole in the event identification number 8 and before the female plate 1 is engaged. The female plate 1 includes a peripheral edge 9. The female plate 1 includes a planar first surface 14 and an arcuate or domed second surface 15. The planar first surface 14 and the arcuate second surface 15 join at approximately the peripheral edge 9. The arcuate second surface 15 is bounded by the peripheral edge 9. The female plate 1 includes a central recess 12 in the second surface 15 and a central orifice 5*a* defined by a lip 5*b*, 6 at the first surface 14. The central orifice 5*a* opens into the central recess 12. The central recess 12 may have a circular or non-circular opening at the second surface 15.

FIG. 4*b* shows the stud head 4 along with apparel 7 engaged with the female plate 1. The stud head 4 has been guided into position in the direction of the arrow where the flexible lip or vane 6 has flexed to allow the stud head past. The flexible lip or vane 6 has then flexed back into position under the stud head 4 to snap-fit and secure the event identification number 8 to the apparel 7.

In FIG. 5, stage one of the three stage assembly sequence features the male plate 2 being offered in the direction of the arrow towards the event identification number 8. Stage two of the assembly sequence features the female plate 1 being offered in the direction of the arrow to locate over stud head 4. Stage three of the assembly sequence features the stud head 4 snap-fitted over the flexible lip or vane 6 of the female plate 1, thereby securing the event identification number 8 to the apparel 7.

EP1634508 makes no allowance for differences in material thicknesses of an athlete's apparel. Such allowance for material thickness, although small, is essential to provide a snap fit of the male and female plates and to provide a definite physical or audible indication of connection to the wearer. If this were not the case, as in EP1634508, there may be occasions when an athlete would assume a connection has been made only to be disappointed mid-way through a race, for example, when the event identification number comes adrift. In the present invention this allowance is provided for by the flexible lip or vane 6, which adjusts by flexing to make allowance for varying thicknesses, folds or creases of typical apparel and participation numbers worn for sporting activities and thus facilitates a positive snap-fit connection, indicating to the athlete audibly, or in a tactile manner, or both, that a secure connection has been made.

By contrast with EP1634508, the device of the present invention may have a flexible lip or vane 6 opposing a non-flexible solid edge or lip 5*b* that define the elliptically shaped orifice 5*a* kin the female plate 1, and a male plate 2 with a stud 3 and a stud head 4.

The invention claimed is:

1. A method to releasably fasten an event identification number to apparel, the method comprising:

obtaining a releasable interlocking device specifically adapted to fasten the event identification number to apparel, the device comprising:

a female plate with a planar first surface and an arcuate second surface, the female plate including a central recess in the second surface and a central orifice at the first surface, wherein the central orifice opens into the central recess; and a male plate with an integral stud that protrudes from a planar surface and includes an overlapping stud head;

inserting the stud head through a hole in the event identification number positioned adjacent the apparel; and using the stud head to push the apparel through the central orifice in the female plate, such that the stud head and apparel are received in the central recess of the female plate as the stud extends through the central orifice, to fasten the event identification number to the apparel.

2. A method according to claim 1, wherein the central orifice at the second surface is circular.

3. A method according to claim 1, wherein the central orifice at the second surface is non-circular.

4. A method according to claim 1, wherein the central recess has an opening at the second surface and wherein the central orifice is offset relative to the opening at the second surface.

5. A method according to claim 1, wherein the female plate includes a peripheral edge having a curved first part and a straight second part that extends along a chord of the curved first part.

6. A method according to claim 1, wherein the central orifice of the female plate is a non-circular central orifice defined by a shaped lip, which flexes when the stud of the male plate and apparel are presented for fastening in the central recess.

7. A method according to claim 1, wherein the central orifice of the female plate is defined by a shaped lip, which flexes when the stud of the male plate and apparel are presented for fastening in the central recess.

8. A method to releasably fasten a releasable interlocking device to apparel, the method comprising:

obtaining the releasable interlocking device, the device comprising:

a female plate with a planar first surface and an arcuate second surface, the female plate including a central recess in the second surface and a central orifice defined by a shaped lip at the first surface, wherein the central orifice opens into the central recess; and a male plate with an integral stud that protrudes from a planar surface and includes an overlapping stud head; and using the stud head to push the apparel through the central orifice in the female plate, thereby engaging and lip of the female plate with the stud head and apparel, causing the lip to flex as the stud head and apparel are received in the central recess of the female plate, to fasten the releasable interlocking device to the apparel.

9. A method according to claim 8, wherein the central orifice at the second surface is circular.

10. A method according to claim 8, wherein the central orifice at the second surface is non-circular.

11. A method according to claim 8, wherein the central recess has an opening at the second surface and wherein the central orifice is offset relative to the opening at the second surface.

12. A method according to claim 8, wherein the female plate includes a peripheral edge having a curved first part and a straight second part that extends along a chord of the curved first part.

13. A method according to claim 8, wherein the female plate comprises a circular central orifice defined by a shaped flexible lip, which friction-flexes when the stud of the male plate and apparel are presented for fastening in the central recess.

14. A releasable interlocking device specifically adapted to fasten an event identification number to apparel, the device comprising:

a female plate with a planar first surface and an arcuate second surface, the female plate including a central recess in the second surface and a central orifice defined by a lip at the first surface, the female plate has a peripheral edge and the arcuate second surface is bounded by the peripheral edge; and a male plate with an integral stud head that protrudes from a planar surface and includes an overlapping stud head;

wherein the stud head is sized and configured to pass through a hole in the event identification number positioned adjacent the apparel and to push a portion of the apparel covering the stud head through the central orifice in the female plate, thereby disposing the stud head and the portion of apparel in the central recess of the female plate and disposing another portion of the apparel between the first surface of the female plate and the planar surface of the male plate, to fasten the event identification number to the apparel.

15. A releasable interlocking device according to claim 14, wherein the central orifice is offset relative to the central recess at the second surface.

16. A releasable interlocking device according to claim 14, wherein the central recess has a circular opening at the second surface.

17. A releasable interlocking device according to claim 16, wherein the central orifice has a non-circular shape, and the central orifice is offset relative to the circular opening at the second surface.

18. A releasable interlocking device according to claim 14, wherein a peripheral edge of the female plate includes a curved first part and a straight second part.

* * * * *